United States Patent [19]

Eskridge et al.

[11] 3,983,610

[45] Oct. 5, 1976

[54] APPARATUS FOR PRODUCING TEXTURED YARN

[75] Inventors: Brewster B. Eskridge; Roger H. Fink; William D. Porter, all of Asheville; Elbert K. Warren, Candler, all of N.C.

[73] Assignee: Akzona Incorporated, Asheville, N.C.

[22] Filed: Oct. 24, 1974

[21] Appl. No.: 517,802

[52] U.S. Cl. ..... 28/1.6; 28/1.7

[51] Int. Cl.[2] ..... D02G 1/12

[58] Field of Search ..... 28/1.3, 1.4, 1.6, 1.7, 28/72.11, 72.12, 72.14

[56] References Cited

UNITED STATES PATENTS

| | | | |
|---|---|---|---|
| 3,343,240 | 9/1967 | Parmeggiani et al. | 28/1.3 |
| 3,409,956 | 11/1968 | Longbottom et al. | 28/1.3 |
| 3,559,254 | 2/1971 | Stanley | 28/1.6 |
| 3,693,222 | 9/1972 | Caffry | 28/1.6 |
| 3,707,745 | 1/1973 | Nikkel | 28/1.3 |
| 3,810,285 | 5/1974 | Ferrier et al. | 28/1.3 X |
| 3,824,656 | 7/1974 | Bauch | 28/1.3 |
| 3,840,950 | 10/1974 | Stanley | 28/1.3 |
| 3,852,857 | 12/1974 | Ethridge et al. | 28/1.3 |
| 3,895,420 | 7/1975 | Sturtz et al. | 28/72.14 |

FOREIGN PATENTS OR APPLICATIONS

| | | | |
|---|---|---|---|
| 861,327 | 2/1961 | United Kingdom | 28/72.12 |

*Primary Examiner*—Robert R. Mackey
*Attorney, Agent, or Firm*—Craig & Antonelli

[57] ABSTRACT

Multifilament synthetic polymer yarn is texturized by passing the yarn in a gas stream to a diffuser zone to cause the gas to expand and the yarn filaments to splay open. The yarn filaments are then separated from the expanding gas stream towards a continuous smooth side wall surface defining one end of a bulking chamber. At this end of the chamber the filaments are impacted with each other and the smooth wall surface to form a compact yarn mass. This yarn mass is pushed into and through a slotted portion of the bulking chamber. Simultaneously the gas passes through the yarn mass initially formed in the chamber and then discharges laterally from this mass as it is pushed into the slotted portion.

15 Claims, 4 Drawing Figures

APPARATUS FOR PRODUCING TEXTURED YARN

BACKGROUND OF THE INVENTION

This invention relates to the production of texturized yarns or like multifilament groups of synthetic polymeric materials, e.g. tows, and more particularly to an apparatus and process for texturizing yarn to provide uniform random crimps in the filaments of the yarn by pneumatically conveying the yarn into a bulking chamber to form an elongated uniformly compacted yarn mass and to the yarn products resulting from the process.

Heretofore, many apparatus and processes have been developed for texturizing yarn made of thermoplastic polymeric materials by the use of fluid jets or like pneumatic means. Many of these prior developments have been relatively successful in providing bulky voluminous yarn having a degree of crimp uniformity and improved dyeing characteristics suitable for use in the production of textile fabrics, carpets and the like. However, the apparatus employed for carrying out many of these known processes is complex and requires elaborate machining techniques to produce. This apparatus is costly and for this reason less elaborate and slower stuffer box crimping systems, wherein relatively straight feeder yarn is forced into a compression chamber by a pair of driven rolls and is accumulated within the chamber by pressure developed within the chamber, are often employed. In these systems the feeder yarn forms wads of yarn in the compression chamber and a regular crimp is imparted to the individual filaments of the yarn during this accumulation. Also heated fluids such as steam or hot air are often utilized to moisten and/or heat-set the yarn while in a crimped state within the compression chamber.

Because of the advantages found in the yarns produced by the pneumatic bulking or texturizing systems, particularly the high yarn processing speeds, and random crimping of the filaments, the difficulties in producing the necessary apparatus as well as the complex controls required for operating such apparatus have been accepted by the industry. In these known processes an initially straight and pre-drawn yarn which may be untwisted or slightly twisted is subjected to a turbulent fluid, such as steam, in such a manner that the individual filaments of the yarn are looped, coiled, or crimped and the yarn is heat-set in this condition. The individual filaments are in this manner formed into a bulky wool-like product wherein each of the filaments in a relaxed condition exhibit a plurality of crimps or loops along a given length. These crimps are usually offset and out of phase with each other in a random manner.

One difficulty encountered in these known pneumatic processes is a requirement to provide a sufficient number of crimps to a given length of yarn. Often it is difficult to obtain consistently more than 10 crimps per inch in the filaments of the resulting yarn product.

Many prior attempts to improve the crimp count involve procedures to impinge, fold or coil the yarn in such a manner that the yarn filaments are highly crimped while allowing the yarn to be subsequently removed from the apparatus without loss of desired yarn properties.

Also, the procedures used for separating the yarn from the fluid stream, usually hot air or steam, are important to the success of the crimping process. Various devices such as angled baffles, bulking tubes with reverse exhaust bulking chambers with lateral exhaust ports, rotating screen drums and the like have been employed. The use of such devices often imposes limitations of yarn speed, yarn uniformity or process flexibility on the known processes.

In order to overcome a number of drawbacks attendant to these pneumatic bulking techniques, several developments have been made. For example, U.S. Pat. No. 2,982,082 discloses a process and apparatus for producing voluminous yarn wherein a continuous filament yarn is fed into a jet by a pair of rollers. The jet has an inlet tube extending through a chamber and is provided with a jet tip which faces and enters the mouth of a venturi passage. The outer surface of the jet and the mouth of the venturi cooperate to form an annular passage for a fluid stream under pressure to be blown into the chamber and out through the venturi. The yarn is drawn out of the jet by an additional pair of rollers at such a rate that the yarn is overfed to the jet so that the individual filaments of the yarn are formed into loops and curls by the turbulence of the air stream beyond the annular passage within the jet.

U.S. Pat. No. 3,373,470 described a process for stuffer-type crimping of thermoplastic filaments wherein the filaments are introduced into one end of an elongated confined space by a stream of fluid such as steam under pressure and at a temperature sufficient to set the filaments. The filaments are tightly packed within the confined space by controllable releasing part of the fluid from the confined space laterally of the confined space at a position spaced from the other end and the packed filaments are then forced through the space to the other end under pressure by the remaining portion of the fluid which exhausts with the yarn. The confined space required for this process is defined by a metal spring having gaps between the convolutions thereof. In this apparatus the yarn is propelled by the action of the fluid from a nozzle through a tubular passage and then into the interior of the spring. The spring is curved to a desired extent to obtain optimum packing of the yarn therein.

U.S. Pat. No. 3,380,242 described yet another process for providing a crimp to synthetic yarns wherein the yarn is subjected to the action of a turbulent stream by passing it through a jet to which a hot gas is supplied. The yarn and hot gas leaving the jet enter a venturi tube wherein the individual filaments of the yarn while in a plastic state and under substantially zero tension are separated from each other and crimped individually while whipping about in the turbulent plasticizing stream. The crimp produced by this process has a random three-dimensional curvilinear extensible configuration.

There are still a number of drawbacks, such as uneven or irregular dyeing characteristics, non-uniform crimping and the occurrence of snarls or tangles in the yarn which need to be overcome. For example, in the manufacture of tufted carpets it has been found that tufting machines require particularly uniform yarns and that snarled yarns will cause stoppage, broken filaments and even end breakage. Also, the snarled or tangled yarn will provide faults in the carpet product. Therefore, manufacturers of texturized carpet yarns are continuously looking for apparatus and processes to provide bulky yarns which will dye uniformly and which are free from snarls and tangles.

SUMMARY OF THE INVENTION

Advantageously, the present invention provides a continuous pneumatic process that produces bulky yarns having a high degree of random crimp and that can be carried out at high speeds by an apparatus which is simple to manufacture and which can be operated without elaborate controls. Furthermore, the dense yarn mass produced during the process of this invention is characterized by a symmetrical compact arrangement of the filaments which enables the yarn to be easily removed from the apparatus. This yarn mass provides a bulky yarn product that has a highly uniform and even random crimp in each of the filaments and that is substantially free of snarls and tangles.

This invention contemplates a process for texturizing or bulking a multifilament synthetic polymeric yarn wherein the yarn is passed in a gas stream to a diffuser zone to cause the gas to expand and the yarn filaments to splay open; the yarn filaments are directed away from the expanding gas stream towards a continous smooth side wall surface defining one end of a bulking chamber; the filaments are impacted with each other and the smooth side wall surface to form a compact yarn mass at the one end of the bulking chamber; and the yarn mass is pushed into and through a slotted side wall or otherwise gas permeable portion of the bulking chamber; while the gas simultaneously passes through the yarn mass initially formed at one end of the bulking chamber and then discharges laterally from the yarn mass pushed into the slotted portion of the bulking chamber.

In this process, the yarn is initially delivered at a constant speed by a feeding device such as feed rollers, godet or the like to a bulking jet. Delivery yarn speeds of from 500 to 2,000 meters per minute may be used; preferably the speeds are from 1,000 to 1,500 meters per minute. Prior to entering the bulking jet, the yarn is preheated to 100°C to 200°C. by a plate heater, godet or like heating device or in some cases, the yarn is heated by being drawn immediately before entering the bulking jet.

The yarn is then aspirated into the bulking or aspirator jet by the venturi effect of a heated gas, such as superheated steam or compressed air. The yarn carried in the gas stream then enters a preheat tube where the yarn temperature is raised by the heated gas to plasticize the yarn prior to crimping and/or folding in the bulking chamber. In the preheat tube, the yarn is heated to temperatures between the second order transition point and the melting point of the yarn; the temperature of the yarn is maintained below the sticking point to avoid the formation of separate coherent filament groups within the yarn.

The yarn and gas stream exit from the preheat tube into a diffuser zone having a diverging conical wall surface. In this zone, the gas is expanded very rapidly to create great turbulence, thereby causing the yarn filaments to splay open, to flutter violently, and to move towards the conical wall surface. Folding-over of the yarn filaments occurs as the filaments impinge against each other and a smooth side wall surface of a plug forming zone of the bulking chamber immediately adjacent to and downstream from the diffuser zone. Consequently, the yarn accumulates at the front end of the bulking chamber to form a compacted mass in the form of an elongated, cylindrical plug which seals off the downstream end of the bulking chamber. Further accumulation of yarn and the force of the entering gas cause the accumulated yarn plug to be pushed forward into a slotted wall portion of the bulking chamber while the yarn newly entering the chamber impinges at random on the upstream end of the dynamically forming plug in the plug forming zone. All of the gas from the diffuser zone now flows through the compacted yarn mass at the front end of the bulking chamber and after reaching the slotted portion of the bulking chamber, the gas exhausts laterally from the yarn plug. In this manner, the yarn in the smooth wall portion is uniformly treated with the gas to cause crimping and bulk-setting of the yarn.

The yarn filaments, which fold upon each other and themselves and on the smooth side wall surface, are, generally, arranged at an angle to the longitudinal axis of the bulking chamber (as well as the coinciding longitudinal axis of the plug) with intermediate portions forming successive inwardly and outwardly curved folds, or pleats much like those of an accordion. The filaments appear to splay open and then close together in a pulsating manner during formation of the plug. The filaments converge initially form a concave surface towards the downstream end of the chamber upon which subsequent filaments are compacted. This arrangement causes the filaments to be built-up in a conical-like stacked arrangement within the bulking chamber. Generally, the major portions of the filaments form an angle with a plane perpendicular to the longitudinal axis of the chamber that may vary from about 10° to 30°. Also, the smooth side wall surface provides an ironing-effect on the outer surface of the plug. Consequently, when the plug moves forward in the bulking chamber and when the steam exhausts through the slots or perforations in the bulking chamber, yarn is not carried out with the gas which would cause large loops, snarls and other variations in the yarn crimp.

The continuous multifilament yarns to be texturized by this invention are made from various thermoplastic synthetic polymeric materials such as nylon; polyester, e.g. polyethylene terephthalate; polyolefins, e.g. polypropylene; acrylic polymers, e.g. polyacrylonitrile and copolymers of acrylonitrile; polyvinyl chloride, polyphenylene oxides and other fiber-forming materials. Preferably, the yarns used for the purposes of this invention are those made entirely of nylon or polyester. However, yarns made of composite filaments such as nylon and polyester may also be employed.

The denier of the feeder yarns utilized in the practice of this invention may vary from about 50 to 4,000 and the denier used for producing carpet yarns usually varies from about 1,000 to 3,000. These yarns, which are drawn prior to bulking, include twisted or untwisted flat yarn as well as spin-drawn yarn, spun yarn which is subsequently drawn, and the like yarns. Also, the yarn may be drawn immediately before being introduced into the bulking jet. In general, the yarn is drawn at conventional draw ratios employed for orientation of synthetic polymeric filaments prior to crimping, e.g. 2.5 : 1 to 4 : 1; with a draw ratio of 3.6 : 1 being particularly effective for nylon carpet yarns. Partially drawn feed yarns produced from high speed filament spinning may also be utilized, in which case draw ratios before the bulking jet will be proportionately lower during the additional drawing.

The feeder yarn usually will have selected oil and/or emulsion finishes applied thereto to achieve a proper moisture and finish content.

It has been found that the gas used to aspirate the yarn in accordance with this invention advantageously is a dry gas such as superheated steam or compressed air. Preferably, superheated steam is used. This steam has a pressure of from about 50–100 psig. and a temperature from about 200°C. to about 275°C. The preferred pressure for nylon 6 carpet yarns is from 60 to 80 psig. and preferred temperature is from 220°C. to 240°C. Usually the temperature of the steam is above the melting point of the yarn since heat losses in the system and the short residence time of the yarn with the steam prevent the yarn from being raised to this melting temperature.

Air suitable for purposes of this invention can be taken from the atmosphere at ambient conditions and compressed to 50–100 psig. and heated to 200° to 275°C.

After the yarn plug has been pushed from the bulking chamber, the yarn plug, while still intact, is guided through a tubular conduit to a plug guide where the yarn is removed from the plug by a takeup device at a rate that is about 15–25% slower than the feed rate. Sufficient tension is applied to the yarn to cause it to stretch out to a length less than the original length, and to pull the filaments back into a yarn bundle.

Optionally, the yarn may be passed through a tangle jet for additional bulk control to establish desired yarn properties and then through a steam annealing jet before winding into a take-up package. U.S. Pat. No. 461,521 discloses specific annealing and air tangling means that can be utilized.

This invention is also directed to an apparatus for effecting the heretofore described bulking process, which apparatus comprises: (1) a pneumatic aspirator jet having an inlet means for supplying a heated gas to a jet orifice for producing a gas stream within the aspirator, and a yarn inlet means for introducing a yarn into the gas stream; (2) a preheat tube secured to the aspirator jet defining a narrow passage for receiving the yarn carried by the gas stream and for allowing the yarn to be preheated by the gas; (3) a diffuser having a conical diverging surface at the end of said preheat tube; and (4) a bulking chamber adapted to contain a compacted yarn mass therein, said chamber having a smooth side wall portion adjacent to the conical surface of the diffuser for forming the compacted yarn mass and a slotted wall portion for receiving the compacted yarn mass and for discharging gas laterally from said yarn mass.

Advantageously, the position of the front of the plug within the bulking apparatus of this invention remains substantially constant. However, the invention also contemplates control means for regulating the position of the compacted yarn mass, i.e., the yarn plug in the bulking chamber. More specifically, it has been found that the position of the plug is dependent on the temperature and/or pressure of the entering heated gas as well as the temperature of the preheated feeder yarn. Yarn sensing means can be placed in the bulking chamber to determine the position of the initially formed plug. When this portion of the plug is displaced from the smooth wall portion of the bulking chamber onto the slotted portion, the temperature and/or pressure of the gas is decreased sufficiently to cause the yarn plug to return to its proper position on the front smooth wall portion. Likewise, displacement of the plug into the diffuser can be corrected by increasing the temperature and/or pressure.

In another system of the invention, the plug within the bulking apparatus can be controlled by regulating the position of the end of the plug pushed out of the apparatus. The plug is moving at a rate on the order of 1/200th of the yarn input rate in the conduit or like means for guiding the yarn. The plug is directed into a plug guide wherein an accumulator device or yarn sensing means, e.g. feeler elements, contact the yarn. When the plug moves past a predetermined set point, the yarn feeler element closes a switch and thereby causes the apparatus to shutdown. If the yarn recedes toward the inlet of the plug guide and accumulator device, another feeler element and associated switch are actuated to cause shutdown. Between these positions, additional sensing means can be used to regulate the speed of the take-up device. A control device of this type is further described in the application of Roger H. Fink et al. executed on even date herewith (Ser. No. 517,786 filed Oct. 24, 1974).

The process and apparatus of the invention will be further understood from the following detailed description and the accompanying drawings wherein.

DESCRIPTION OF THE PREFERRED EMBODIMENTS

Figure 1:
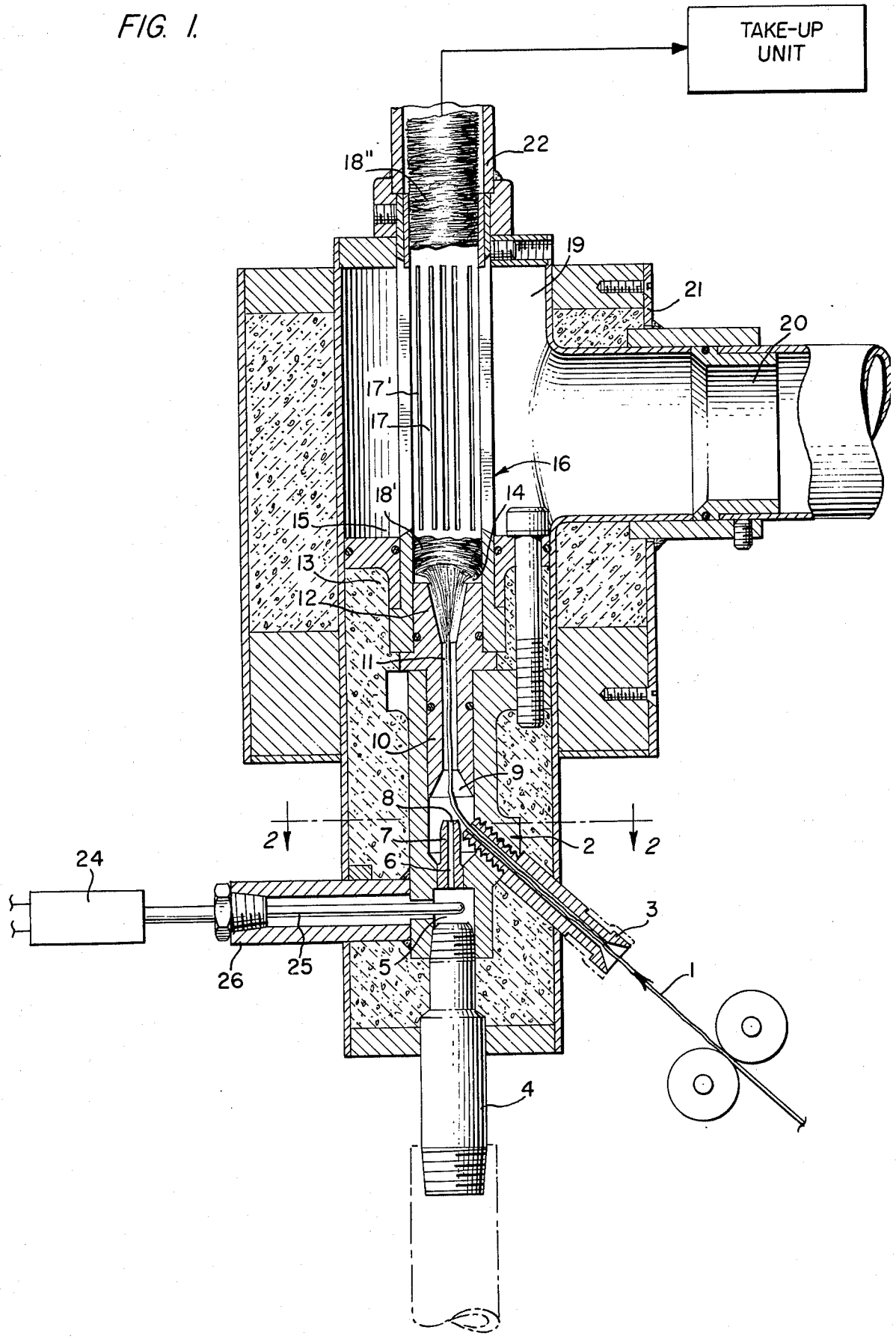
FIG. 1 is a sectional view of a preferred embodiment of the apparatus for texturizing a yarn according to this invention.

In FIG. 1, nylon feeder yarn 1 is drawn from a pair of feed rollers or like feeding device into an aspirator jet unit, generally designated by reference numeral 2, through yarn inlet tube 3. Superheated steam is supplied to the aspirator jet unit by steam inlet pipe 4 and discharges into a temperature sensing zone 5 before passing through a narrow passage 6 of the jet nozzle 7 to the orifice 8.

Figure 2:
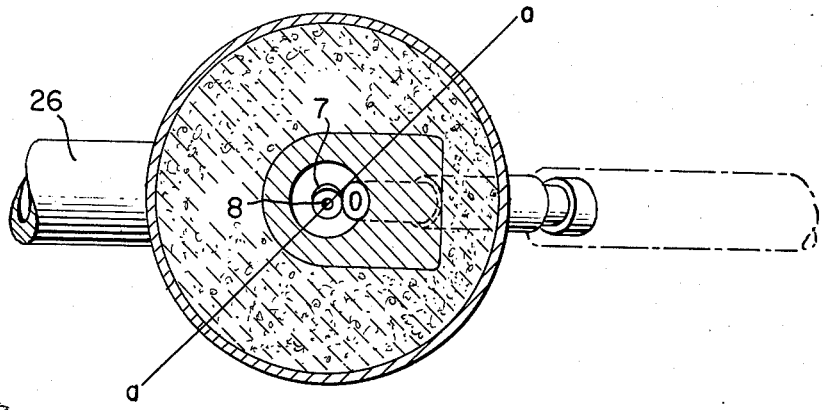
FIG. 2 is a cross-sectional view of the apparatus taken along line 2—2 in FIG. 1.

The longitudinal axis of the yarn inlet tube is arranged at an angle of about 45° with the longitudinal axis of the jet and is positioned with an exit opening upstream of and closely adjacent to the jet orifice. Also, as shown in FIG. 2, the axis of the yarn inlet tube 3 and the axis of the passage 6 leading to the orifice 8 are in the same vertical plane.

Advantageously, it has been found that when the discharge end, i.e., the tip, of the jet nozzle is bent at an angle of from 2° to 8° from the longitudinal axis of the nozzle, the symmetry of the yarn plug, i.e., with respect to the arrangement of the filaments therein and uniformity of its outer surface, is greatly improved. Furthermore, the tip preferably should be bent towards the lower right-hand quadrant of the cross-section shown in FIG. 2, although advantageous effects are also obtained when the tip is bent towards the surrounding sectors that are circumscribed by an arc angle of 45° (the area to the right of line "*a—a*" in FIG. 2 defines the sectors wherein these results are obtained). It will be understood that the "tip" of the jet nozzle refers to about the last ⅜ inch of the nozzle.

It will be appreciated that it is generally preferred also to employ an external preheater means (not shown) such as a plate heater, heated godet, etc. that will heat the yarn to a temperature of from 150°C. – 200°C. before it enters the yarn inlet tube.

The feeder yarn is propelled or carried by the steam through the conically-shaped entrance 9 (having a convergent angle of about 60°) of the preheat tube 10 into passage 11 where the yarn is preheated by the superheated steam to a temperature between the second order transition point and the melting point of the yarn.

The yarn and steam then enter a diffuser 12 at the other end of tube 10 which is also provided with a conical wall 13. The angle of divergence of wall 13 may vary from about 20° to 60° and preferably is about 30°.

In the diffuser, the steam rapidly expands and causes the yarn to splay outwardly towards the surface of wall 13. The flat shoulder 14 at the end of the diffuser creates an eddy-effect to allow the yarn filaments to go onto a smooth wall portion 15 which defines the front end of the bulking chamber 16 and then to fold inwardly against themselves thereby forming a compacted yarn mass. The yarn mass soon accumulates and forms an elongated plug that is pushed into an air permeable, e.g. slotted, wall portion 17 of the bulking chamber by the back pressure developed in the smooth side wall portion due to resistance of the steam flowing through the plug. A plurality of slots 17' are arranged uniformly around the periphery of the chamber. In the embodiment shown, 18 slots are provided in the tubular member defining the bulking chamber. Reference numeral 18 generally designates the plug; whereas 18' refers to the initially formed yarn mass or plug; and reference numberal 18'' designates the portion of the plug extending out of the slotted portion. It will be appreciated that the tubular member forming the air permeable portion of the bulking chamber may be provided with perforations having different configurations, e.g. circular, which are arranged in various patterns to provide uniform escape of gas therefrom. Also, this portion of the chamber could be formed by convolutions of a coil or like wall construction having opening therein. Preferably a slotted tubular member, as shown, is employed since it provides guide strips between the slots that promote displacement of the plug with uniform escape of the steam.

In the smooth side wall portion 15, all of the steam passes axially through the formed plug before discharging laterally through slots 17'. The steam exiting from the slots then collects in an exhaust chamber 19 surrounding the slotted portion of the bulking chamber. The steam is then discharged to the atmosphere or a collecting tank via exhaust pipe 20. A heat insulated shroud 21 surrounds the entire yarn bulking apparatus. Plug 18 is further pushed through a tubular conduit 22 to a take-up unit 23 in a manner similar to that described in the above-referenced Fink application. This unit includes a plug guide for positioning the end of the plug as a yarn bundle is pulled from the plug by a take-up device for winding the yarn into a package.

In order to determine the temperature of the steam just prior to entering the jet nozzle a temperature sensing control 24 with a temperature probe 25 is provided. The temperature probe extends into zone 5 at substantially right angles to the steam entering through inlet pipe 4. A housing 26 is provided for the temperature probe. As heretofore described, the take-up device withdraws the yarn at a rate which is about 15–25% less than the rate the yarn is introduced by the feed means. Both the take-up device and the feed means operate at substantially constant rates. Also, appropriate control means may be provided to allow for variations in the plug formation during operation of the apparatus. These controls have been described heretofore.

From the foregoing detailed description of the apparatus and process, it will be recognized that the present invention provides several advantages in texturizing the yarn. In particular, the smooth wall portion of the diffuser enables the yarn to fold upon itself to form a more uniform plug in that the filaments pack more uniformly to provide greater density and the smooth outer periphery of the plug allows it to pass more uniformly through the bulking chamber. Also, since the yarn filaments, which fold upon themselves on the smooth side wall portion of the bulking chamber, are generally arranged radially inward from the smooth side wall portion and at an angle to its longitudinal axis, when the plug moves forward due to the pressure exerted on it by the steam, the steam is allowed to exhaust through the slots in the slotted portion of the bulking chamber without causing the filaments of the yarn plug to pass into the slots.

Moreover, it is of considerably importance that all of the steam must pass through the initially formed portion of the plug. This results in a more uniform and effective steam heating and conditioning of the filaments in the folded and compacted state. Also, the steam and filaments carried by the steam more uniformly impinge on the initially formed yarn plug since the steam more uniformly impinge on the initially formed yarn plug since the steam does not escape directly to the atmosphere but is controlled by being blown through at least the initially formed portion of the plug. Consequently, the crimps obtained in the filaments are more uniform and evenly distributed throughout.

Because the plug forms on a solid side wall portion of the bulking chamber and all steam passes forward through the plug at this stage of the process, a substantially greater pushing force (i.e., plug compacting force) is exerted on the front of the yarn plug. Consequently, the plug is less sensitive to stack-height variation and thereby permits longer plugs to be utilized without causing variations in the bulkiness and crimps of the yarn. Also, the aspirator jet is less subject to variations due to a change in back pressure since the plug can move forward and backward in the smooth side wall portion of the bulking chamber without changing the exhaust pattern of the steam through the slotted wall portion of the chamber.

It will also be appreciated that since there is a substantially large pushing force available for causing the plug to move forward, since the apparatus is less sensitive to moderate variations in the positioning of the initial plug portion and since all the steam is exhausted from the plug before the plug exits from the top of the slotted portion of the bulking chamber, the end or top of the plug is made available for contact with sensing devices such as microswitches, pneumatic sensors, photoelectric sensors and the like for end-out detection and/or windup speed control. Also, the configuration of the yarn plug is more geometrically defined and has a firm outer periphery thereby enabling the plug to be sensed more easily by feeler type devices.

The process of the invention will be further understood from the following examples:

EXAMPLE 1

A nylon carpet yarn of 136 filaments with trilobal cross-section and a denier of 2,080 after being drawn to an approximate 4.0 draw ratio is taken from a creel and passed over a plate-type heater operated at 188°C. This yarn then enters the nip of two feed rollers and is nipped with sufficient force to pull the yarn across the preheater plate. From the feed rolls, the yarn is introduced into the yarn inlet tube of an apparatus of the type illustrated in FIGS. 1 and 2 of the drawings. This yarn is initially strung up by passing the feeder yarn through the apparatus to be received by an operator who secures the yarn to a take-up device, particularly a flat package take-up device. This take-up device operates at a take-up speed of approximately 835 meters per minute; whereas the feed rate is 980 meters per minute.

Simultaneously, with actuation of the take-up device superheated steam at 235°C. and 75 psig. is introduced into the steam inlet pipe. The yarn is continuously drawn into the bulking apparatus and then passed through a plug guide operatively associated with the take-up device wherein a yarn bundle is continuously separated from the plug at a tension of up to about 5 grams by the take-up device.

The resulting yarn product was evaluated over a week's time and found to exhibit the following average properties:

| | |
|---|---|
| Bulked denier | 2759 |
| Strength (G/Den) | 2.22 |
| Elongation (%) | 58.3 |
| Bulk (%) | 15 |
| Tangle Factor (100 in.) | 217 |
| Crimp Count (1 in.) | 13.0 |
| Shrinkage (%) | 2.9 |
| Finish (%) | 0.8 |

Also, evaluation of the plug revealed that the density of the plug varied from a minimum of about 3.6 g/cu.in. to a maximum of about 3,75 g/cu.in.

EXAMPLE 2

Additional runs were conducted in which the same feeder yarn as used in Example 1 was employed in the same apparatus to produce carpet yarns. Upon evaluation over a period of several weeks, it was found that the denier of the yarn varied from a low of 2722 to a high of 2803 and the average crimp count per inch varied from about 12 to about 14. Also, the other above-noted properties were found to be substantially uniform over this period and comparable to those obtained in Example 1. It will be apparent that these results establish that the process of the present invention provides an exceptionally uniform yarn product having excellent crimp. In all cases, the yarn was found to be substantially free of snarls and tangles.

EXAMPLE 3

Microscopic examination of the yarns produced in the foregoing Examples revealed that each of the filaments has a uniform degree of eveness and crimp and that the crimp count throughout substantially all of the filaments of the yarn varied from 12 to 14, with occasional minute crunodal loops appearing in the filaments. These loops are removed from the yarn upon applying a tension of about 80 grams.

Figure 3:
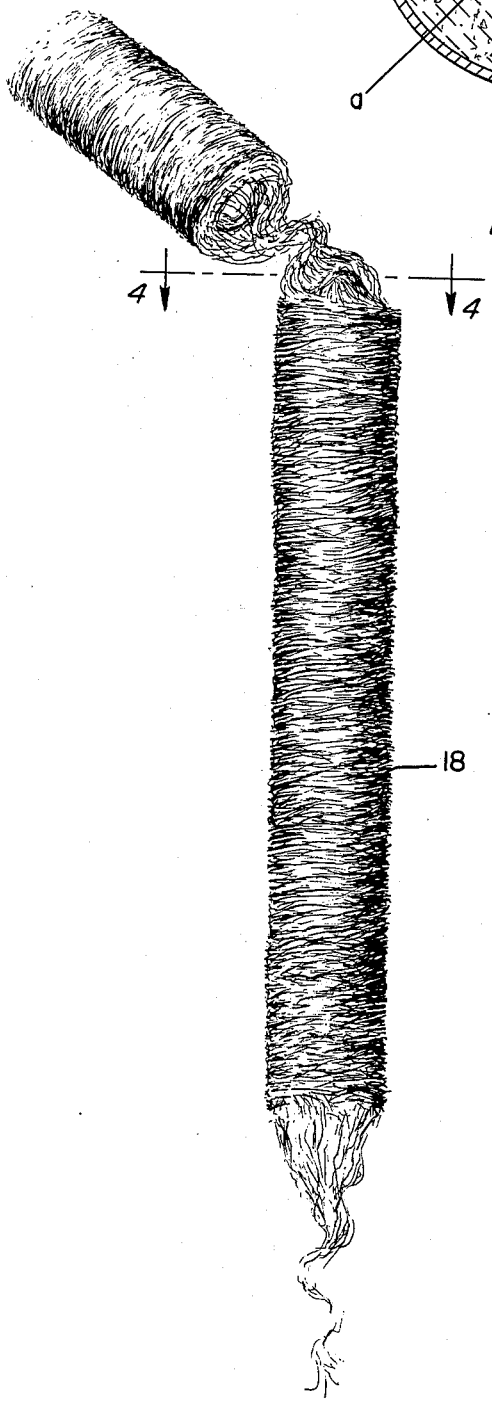
FIG. 3 is a perspective side view of a yarn plug produced by the process of the invention.
Figure 4:
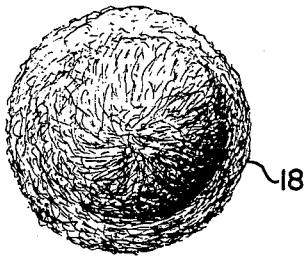
FIG. 4 is a sectional view of the yarn plug taken along line 4—4.

The configuration of the yarn plug or mass of compacted yarn produced by the process exemplified in the foregoing Examples is shown in FIGS. 3 and 4. It will be seen that the plug has a body with an elongated rod-like shape in which the filaments of the yarn are compacted in a dense arrangement. A major portion of the filaments have portions which extend at an angle to the axis of the plug as heretofore described with intermediate portions or sections of the filaments forming alternate inwardly and outwardly curved folds or pleats. The appearance of this arrangement of the filaments is somewhat like that of an accordion. It will be noted that in FIG. 3, an end portion of the semi-rigid body of the plug has been broken away from the remaining portion of the plug to show the arrangement of the filaments.

As further shown in FIG. 3, the filaments when pulled from the plug in the form of a yarn bundle appear to converge together from points evenly distributed alternately at the center and then at the periphery of the plug. These filaments are elongated into the form of a yarn bundle without the occurrence of any snarls or tangles.

EXAMPLE 4

In order to further evaluate the voluminousity of texturized yarn obtained by the process of this invention, additional experiments were conducted. In these experiments, sample lengths of yarn were passed through a sensing head of a G.E. "Qualigard" yarn monitoring device. In general use, the yarn sensing head of this device operates as a backpressure air gaging sensor which detects variations in yarn denier and converts the variations to a minute proportional air pressure.

In the following experiments, the sensing head was employed to provide a backpressure reading that is proportional to the voluminousity of the texturized yarn. Air was supplied to a SHPAV with a constant pressure, i.e., 25 psig. This air enters the sensor slot at its midpoint and escapes through the slot at either end. A yarn passing through the sensor slot impedes the air flow and creates a backpressure proportional to the total effective cross-sectional area of the yarn. The backpressure is converted into a "Qualigard" reading in inches of water, a larger number for equivalent flat denier indicating a more voluminous yarn.

The test apparatus used was a "Qualigard" Model CR 280 YM31A with sensing head No. CR280 GP11A060. This test apparatus was calibrated by inserting a wire having a diameter of 0.0404 into the slot of the sensing head. The air supply to the sensing head pressure adjustment valve was adjusted to 25 psig. and the sensing head pressure adjustment valve was adjusted to read 14 inches of water. Then the yarn sample was passed through the sensor slot at a preset speed of 1 inch per sec. and a tension of 70 grams.

Samples of nylon yarn produced in accordance with the procedure outlined in Example 1 having actual denier of 2700 (Sample A) and samples of nylon yarns (Samples B and C) having deniers comparable to Sample B, which are commercially available, were evaluated. The results of these tests are tabulated below:

| Yarn | Qualigard Reading | Actual Denier |
|---|---|---|
| A | 35 | 2700 |
| B(1) | 22 | 2750 |
| C(2) | 23 | 2600 |
| (1)Product of Allied MERGE 90026 | | (2750) |
| (2)Product of DuPont MERGE 13 828M | | (2600) |

From the above data, it will be apparent that the texturized yarns of the invention are more voluminous than the comparable commercially available yarns.

The smooth tightly packed yarn plug produced by the process of this invention has a density from about 3 to 4 grams per cubic inch. The density and size of the plug are sufficient to permit the plug to be physically handled or manipulated by a machine without any significant distortion. This permits numerous treatments to be made while the yarn is in this compact and slow moving geometry within the apparatus of the invention.

Advantageously, the surface of the yarn plug may also be cut to a shallow depth at spaced intervals around the periphery of the plug. In this manner, some but not all of the filaments in the resulting yarn bundle would be cut resulting in a fuzzy or staple-like yarn product.

It will be further appreciated that various anti-static and/or anti-soiling materials may be added to the yarn while it is retained in the bulk form by directly applying these materials to the plug. Also, additional heat-setting of the yarn can be effected while the yarn is in the plug form.

It will be appreciated that the dimensions of the various elements of the apparatus of the present invention may vary considerably while still providing the necessary passages for bulking of the yarn. Generally, the nozzle jet has a diameter that is equal to or approximately one-half the diameter of the preheat tube. Also, the bulking chamber usually has a diameter of at least about seven times the diameter of the nozzle jet with a smooth side wall portion of at least about one-half inch to insure the formation of a suitably sized plug. Moreover, the length of the entire bulking chamber usually varies from about three to ten times its diameter with the slots provided in the slotted wall portion each having a width from a few to several one hundreds of an inch.

It will be appreciated that at the higher operating pressures, e.g. at 70 psig. or above, the aspirating effect that occurs at the yarn inlet of the jet means is no longer apparent, i.e. the pressure goes from negative to positive during the bulking operation.

While the novel embodiments of the invention have been described, it will be understood that various omissions, modifications and changes in these embodiments may be made by one skilled in the art without departing from the spirit and scope of the invention.

What is claimed is:

1. An apparatus for texturizing yarn which comprises a pneumatic aspirator jet having an inlet for supplying a heated gas to a jet means for producing a gas stream within the aspirator jet and a yarn inlet means for introducing a yarn into the gas stream; a preheat tube secured to the aspirator jet defining a narrow passage for receiving the yarn carried by the gas stream and for allowing the yarn to be preheated by the gas; a diffuser having a diverging conical surface at an end of said preheat tube; and a bulking chamber, said chamber having a smooth wall portion that is adjacent to the conical surface of the diffuser and that has a length sufficient to insure formation of a compacted yarn mass therein and said diffuser having a flat shoulder perpendicular to the smooth wall portion of said chamber, whereby an eddy-effect is created to cause yarn filaments splayed outwardly in said diffuser to contact said smooth wall portion and to form a compacted yarn mass therein and heated gas exiting from the diffuser is passed through the compacted yarn mass whereby a uniform compacted yarn mass is produced and said chamber having a gas permeable wall portion for receiving the compacted yarn mass formed in the smooth wall portion and for discharging gas laterally from the yarn mass therein.

2. The apparatus of claim 1, wherein the bulking chamber is formed by a tubular member and the gas permeable wall portion has a plurality of slots spaced around the periphery of said tubular member, said slots extending parallel to each other and to a longitudinal axis of said tubular member.

3. The apparatus of claim 2, further comprising a shroud means surrounding the slotted wall portion of the bulking chamber as well as the aspirator jet, preheat tube and diffuser, said shroud means including a chamber for exhausting gas discharged from said slotted wall portion and insulating means for preventing heat losses from said apparatus.

4. The apparatus of claim 1, wherein said preheat tube has a longitudinal axis and the conical surface of said diffuser diverges at an angle of from about 20° to 60° with respect to the longitudinal axis of said preheat tube.

5. The apparatus of claim 1, wherein said shoulder comprises an annular shoulder that extends inwardly from the smooth wall portion of said bulking chamber and the eddy-effect also enables the filaments to separate from the expanding gas stream exiting from said diffuser.

6. The apparatus of claim 1, wherein the bulking chamber is formed by a tubular member.

7. The apparatus of claim 1, wherein said jet means includes a nozzle jet having a longitudinal axis and said yarn inlet means is an inlet tubular member having a longitudinal axis that is arranged in the same plane as the longitudinal axis of said nozzle jet and at an angle of from about 20° to 60° thereto.

8. The apparatus of claim 1, further comprising means for withdrawing a yarn bundle from the yarn mass exiting from the bulking chamber.

9. The apparatus of claim 1, wherein the gas permeable wall portion of said bulking chamber is longer than the smooth wall portion whereby a plurality of compacted yarn masses successively formed in said smooth wall portion accumulate within said gas permeable wall portion.

10. The apparatus of claim 1, wherein said jet means includes a nozzle jet and the smooth wall portion of the bulking chamber has a length of at least one-half inch and a diameter of at least about seven times the diameter of the nozzle jet, the length of the bulking chamber varying from three to ten times the diameter of the bulking chamber.

11. The apparatus of claim 1, wherein the bulking chamber is formed by a tubular member which has a constant diameter.

12. An apparatus for teturizing yarn which comprises a pneumatic aspirator jet having an inlet for supplying a heated gas to a jet means for producing a gas stream within the aspirator jet and a yarn inlet means for introducing the yarn into the gas stream, said jet means including a nozzle jet having a longitudinal axis and said yarn inlet means comprising an inlet tubular member having a longitudinal axis that is arranged in the same plane as the longitudinal axis of said nozzle jet and at an angle of from about 20° to 60° thereto, and the tip of said nozzle jet being bent at an angle of about 2° to 8° with respect to its longitudinal axis; a preheat tube secured to the aspirator jet defining a narrow passage for receiving the yarn carried by the jet stream and for allowing the yarn to be preheated by the gas; a diffuser having a diverging conical surface at the end of said preheat tube; and a bulking chamber adapted to contain a compacted yarn mass therein, said chamber having a smooth wall portion adjacent to the conical surface of the diffuser for forming the compacted yarn mass and a gas permeable wall portion for receiving the compacted yarn mass and for discharging gas laterally from said yarn mass, the angular position of said tip of said nozzle jet improving the symmetry and the uniformity of the outer surface of the compacted yarn mass.

13. The apparatus of claim 12, wherein the tip of said nozzle jet is bent toward the lower right-hand quadrant of a cross-section of the aspirator jet shown in FIG. 2.

14. In an aspirator jet for a yarn bulking apparatus wherein said aspirator jet has a jet means for producing a gas stream within said aspirator jet, a yarn inlet means for introducing a yarn into the gas stream, and a bulking chamber for forming a compacted yarn mass therein, the improvement wherein said jet means comprises a nozzle jet having a longitudinal axis and a tip extending into a chamber within said aspirator jet, the tip being bent at an angle of about 2° to 8° with respect to its longitudinal axis, and said yarn inlet means is an inlet tubular member extending into said chamber in close proximity to said tip and having a longitudinal axis that is arranged in the same plane as the longitudinal axis of said nozzle jet and at an angle of from about 20° to 60° thereto, the angular position of said tip of said mozzle jet improving the symmetry and the uniformity of the outer surface of the compacted yarn mass.

15. The aspirator jet of claim 14, wherein the tip of said nozzle jet is bent toward the lower right-hand quadrant of a cross-section of the aspirator jet shown in FIG. 2.

* * * * *

UNITED STATES PATENT OFFICE

CERTIFICATE OF CORRECTION

Patent No. 3,983,610 Dated October 5, 1976

Inventor(s) Brewster B. ESKRIDGE et al.

It is certified that error appears in the above-identified patent and that said Letters Patent are hereby corrected as shown below:

Column 2, line 31, delete "controllable" and insert -- controllably --.

Column 5, line 30, delete "461,521" and insert -- 3,461,521 --.

Column 8, line 23, delete "considerably" and insert -- considerable --.

Column 8, lines 31 and 32, delete "more uniformly impinge on the initially formed yarn plug since the steam".

Column 9, line 43, delete "3,75" and insert -- 3.75 --.

Column 14, line 19, delete "mozzle" and insert -- nozzle --.

Signed and Sealed this

Eighth Day of March 197

[SEAL]

*Attest:*

RUTH C. MASON
*Attesting Officer*

C. MARSHALL DANN
*Commissioner of Patents and Trademark*